US005205470A

United States Patent [19]

Cadwell

[11] Patent Number: 5,205,470

[45] Date of Patent: Apr. 27, 1993

[54] METHOD AND APPARATUS FOR SUPERPLASTIC FORMING OF HOLLOW PARTS

[75] Inventor: Gilbert C. Cadwell, Lakeside, Calif.

[73] Assignee: Rohr, Inc., Chula Vista, Calif.

[21] Appl. No.: 264,392

[22] Filed: Oct. 31, 1988

[51] Int. Cl.[5] ..... B23K 31/02

[52] U.S. Cl. ..... 228/265; 228/18; 72/372; 72/362; 72/709; 72/60

[58] Field of Search ..... 72/60, 709, 362, 372; 228/265, 18

[56] References Cited

U.S. PATENT DOCUMENTS

| | | | |
|---|---|---|---|
| 4,141,484 | 2/1979 | Hamilton et al. | 72/364 |
| 4,145,903 | 3/1979 | Leach et al. | 72/60 |
| 4,559,797 | 12/1985 | Raymond | 72/63 |
| 4,584,860 | 4/1986 | Leonard | 72/61 |
| 4,713,953 | 12/1987 | Yavari | 72/60 |
| 4,889,276 | 12/1989 | Cadwell et al. | 228/265 |
| 4,901,552 | 2/1990 | Ginty et al. | 72/60 |

*Primary Examiner*—Stephen J. Lechert, Jr.
*Attorney, Agent, or Firm*—Patrick J. Schlesinger; Frank D. Gillam

[57] ABSTRACT

A method and apparatus for superplastic and diffusion bonding of hollow metal parts which are generally surfaces of rotation. A hollow frangible ceramic die having an interior shaping surface is provided. A metal part to be shaped is placed against the shaping surface (together with any other metal components to be diffusion bonded to the part during forming) and the remainder of the die is covered with sheet metal pieces, all of which are sealed together and to the part to form a gas-tight enclosure for the die. The enclosure is flushed with an inert gas and/or evacuated through an opening in the enclosure. The assembly is placed in an autoclave and exposed to an appropriate pressure and temperature to superplastic form the part outwardly against the shaping surface. The assembly is cooled and removed from the autoclave, then the enclosure is removed. The die is broken away, freeing the formed part.

14 Claims, 2 Drawing Sheets

METHOD AND APPARATUS FOR SUPERPLASTIC FORMING OF HOLLOW PARTS

BACKGROUND OF THE INVENTION

This invention involves the superplastic shaping and diffusion bonding of metal parts and, in particular, the shaping and bonding of hollow parts in a frangible die.

Superplastic forming and diffusion bonding have been found to have a number of advantages in the manufacture of parts, particularly for high strength, light weight, aerospace applications. A number of high performance alloys, such as titanium and aluminum alloys, exhibit superplasticity; that is, the capability of developing unusually high tensile elongation with little tendency toward local necking during deformation. Many of these alloys can be bonded together by diffusion bonding; that is, the solid-state, metallurgical joining of metal surfaces by applying appropriate temperature and pressure for a time sufficient to permit co-mingling of atoms at the joint interface. In combination, these two techniques promise greater manufacturing efficiency, lower labor costs and great material savings through much reduced machining.

Superplastic forming and diffusion bonding are often accomplished through hot isostatic pressing in which a uniform pressure is applied while the components are maintained at a suitable high temperature.

Hot isostatic pressing of flat or nearly flat parts has long been used to form metal, plastic and composite parts to precise dimensions. Typically, a die having a forming surface is placed with the forming surface uppermost. The material to be formed is placed on the forming surface and a blanket or bag is placed over the assembly. The enclosed space is evacuated or flushed with an inert gas. The assembly is placed in an autoclave and subjected to high temperatures and pressures for an appropriate period. While this process is very effective for producing flat or nearly flat structures, problems are encountered with more three-dimensional structures, especially with hollow structures.

Attempts have been made to design complex, removable molds for hot isostatic pressing of complex or hollow shapes. Typical of these is the mold system disclosed by Borchert et. al. U.S. Pat. No. 4,575,327. These molding systems require a large number of parts, sliding together at angles which will permit removal after molding. The molds are expensive, have a short life, difficult to design, and produce imprecise, out-of-tolerance parts with flash or other surface irregularities unless very carefully assembled.

In some cases, particulate material has been used to apply approximately isostatic pressure for hot isostatic pressing of complex parts. Such an arrangement is described, for example, by Rigby et. al. in U.S. Pat. No. 4,552,710. Precise shaping is difficult with such materials and interaction between particles may prevent true isostatic pressure application.

In some cases, superplastic forming and diffusion bonding are combined in a two step process. For example, as disclosed by Cogan in U.S. Pat. No. 4,071,183, two parts can be formed by superplastic forming, then reinforcing pieces can be placed between the parts and diffusion bonded thereto. This complex method has difficulty in obtaining proper alignment of parts and obtaining uniform diffusion bonding.

Simultaneous superplastic forming and diffusion bonding is possible with simple structures, such as is shown by Elrod in U.S. Pat. No. 4,263,375. Here, a simple rib at the bottom of a rectangular cavity is diffusion bonded to a sheet which is pressed down into the cavity and into contact with the rib by gas pressure. This method is effective with simple structures but cannot accommodate hollow structures or those with significant undercuts.

Thus, there remains an unmet need for a method and apparatus for superplastic forming and diffusion bonding of hollow structures with undercuts or other mold interference areas.

SUMMARY OF THE INVENTION

The above problems, and other, are overcome by this invention which uses a hollow, internally configured frangible ceramic die as the forming surface for superplastic forming and/or diffusion bonding of metal parts to produce a hollow product.

A hollow ceramic die is prepared which is generally a surface of revolution. The interior of the die is configured as a shaping surface corresponding to the outer surface of the product to be produced. Metal parts, such as sheets, rings or the like are placed against the shaping surface. All of the outer surfaces of the die are enclosed in sheet metal covers which are bonded together and to the parts, such as by welding, so as to form a gas-tight enclosure surrounding the die. An opening is preferably provided through the enclosure to permit it to be flushed with an inert gas and evacuated, after which the opening is sealed.

The resulting assembly is placed in a suitable autoclave or oven and heated to the desired forming/bonding temperature. Pressure is raised to the proper forming/bonding level and held for a suitable time. Then, pressure is released and the assembly is cooled and removed from the autoclave.

The sheet metal enclosure is cut away from the part and the ceramic die is broken away, freeing the formed part. The exterior of the part has a very precise, uniform and smooth surface corresponding to the die surface. No flash or other irregularities are present, as would be the case with a die assembled from a multiplicity of components.

BRIEF DESCRIPTION OF THE DRAWING

The invention will be more readily understood by reference to the detailed description below of certain preferred embodiments taken in conjunction with the accompanying drawing wherein.

DETAILED DESCRIPTION OF THE INVENTION

Figure 1:
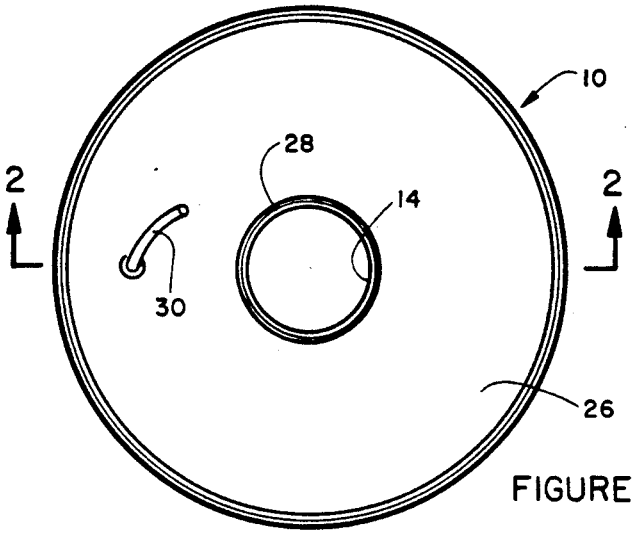
FIG. 1 is a plan view of the forming assembly of my invention.
Figure 2:
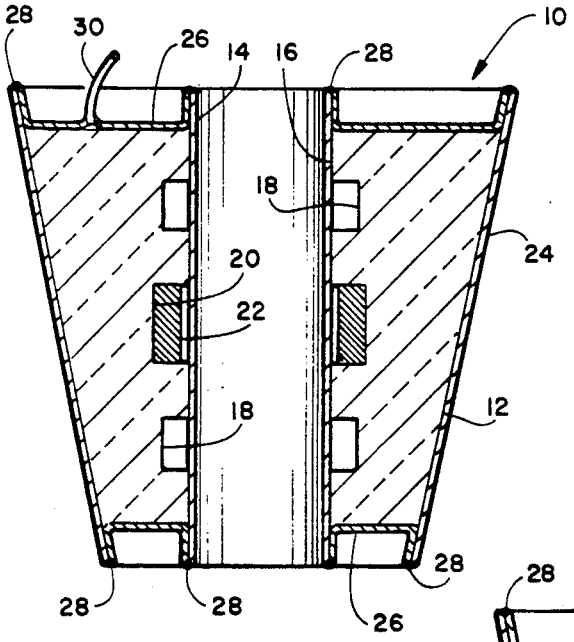
FIG. 2 is a vertical section view taken on line 2—2 in FIG. 1 prior to forming.

Referring now to FIGS. 1 and 2, there is seen a forming assembly 10. The main component of assembly 10 is the hollow frangible ceramic die 12. Die 12 ordinarily is a surface of revolution. While the die 12 shown here has a frusto-conical outer surface and an irregular cylindrical inner surface, these may be varied and have any suitable shape.

Any suitable frangible ceramic material may be used for die 12. Typical ceramics include alumina, titania, fused silica and mixtures thereof. Of these, alumina and fused silica are preferred because of their excellent strength and frangibility.

A part 14 to be reshaped is placed against the inner forming surface 16 of die 12. In this case, part 14 is tubular in cross-section. Part 14 could typically be frusto-conical, or could be laid-up by winding thin sheets of metal against the shaping surface 16.

In the embodiment shown, two outwardly extending ring-like depressions or cavities 18 are formed in shaping surface 16. A third ring-like depression 20 holds a part 22 to be diffusion bonded to part 14. Part 22 may typically be one or more ring segments or would be a narrow metal coil wound into cavity 20.

An outer cover 24 surrounds the outer, frusto-conical surface of die 12. The ends of die 12 are covered by end covers 26. Covers 24 and 26 are sealed to each other and to part 14 by weld beads schematically illustrated at 28 to enclose die 12 in a gas-tight enclosure. Any suitable material can be used for covers 24 and 26. Best results are obtained with sheet titanium.

It is ordinarily preferred to flush the interior of the enclosure with an inert gas and to evacuate it to prevent oxidation of the metal part 12 during the forming operation. A flush and evacuation tube is schematically indicated at 30. Once flushing and/or evacuation is complete, tube 30 is sealed such as by crimping or welding.

The complete forming assembly 10 is then placed in a conventional hot isostatic oven or autoclave and heated to the desired superplastic forming temperatures, which generally are in the 1600° to 1700° F. range. The temperature should not exceed 1750° F.

When assembly 10 has stabilized at the selected temperature, the pressure within the autoclave is increased to cause part 14 to expand outwardly into intimate contact with the inner shaping surface 16 of die 12, including ring-like cavities 18 and into contact with parts 22 in cavities 20. After a suitable period to permit complete forming and diffusion bonding of part 14 to parts 22, heat is turned off and pressure is released.

Figure 3:
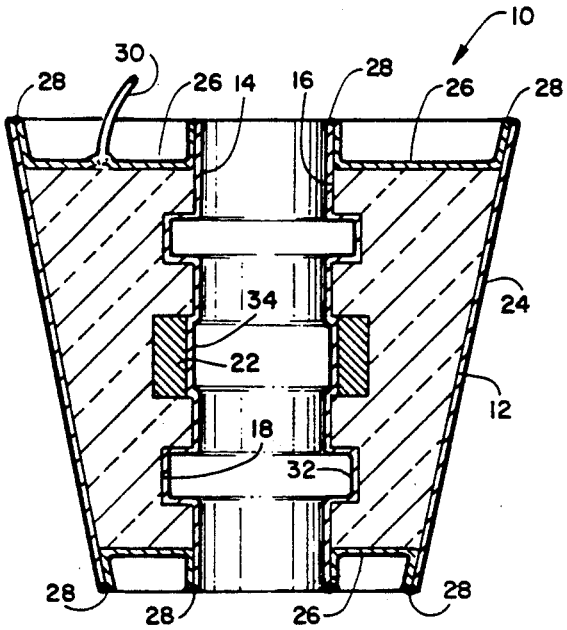
FIG. 3 is a vertical section view taken on line 2—2 in FIG. 1 after forming is complete.

FIG. 3 illustrates assembly 10 upon completion of the forming operation. Portions of part 14 at 32 have pressed into cavities 18 and have taken the precise shapes of those cavities. Portions of part 14 at 34 have pressed inwardly of cavity 20 into intimate contact with parts 22 and have become diffusion bonded thereto.

Once temperature and pressure have been reduced to the desired degree, the autoclave is opened and assembly 10 is removed. Enclosure covers 24 and 26 are removed, such as by grinding away welds 28. The formed part 14 is removed by breaking away ceramic die 12. If desired, the outer lower weld 28 may be ground away before removing die 12 and the formed part. In some cases, cover 12 together with lower covers 26 can be reused. The outer surface of part 14 is found to precisely conform to the inner surface of die 12, with no flash or irregularities as would be expected with a multi-part die.

Figure 4A:
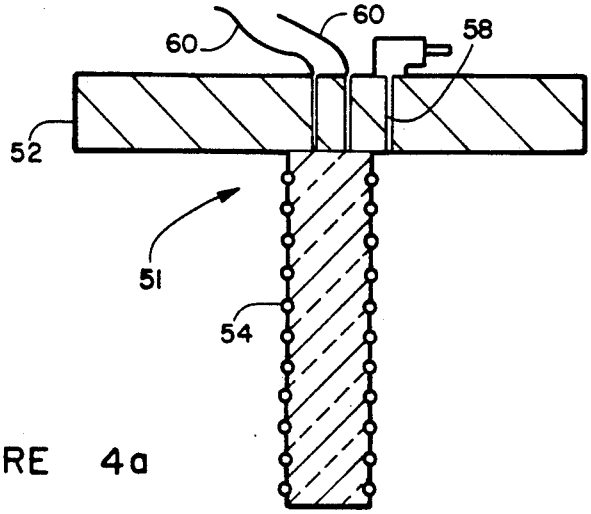
FIGS. 4*a*–4*c* together form an exploded axial section view, schematically illustrating the heater, forming assembly and heater combination respectively.
Figure 4B:
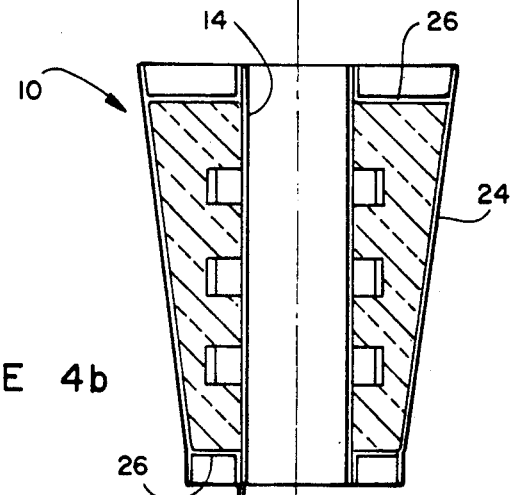
Figure 4C:
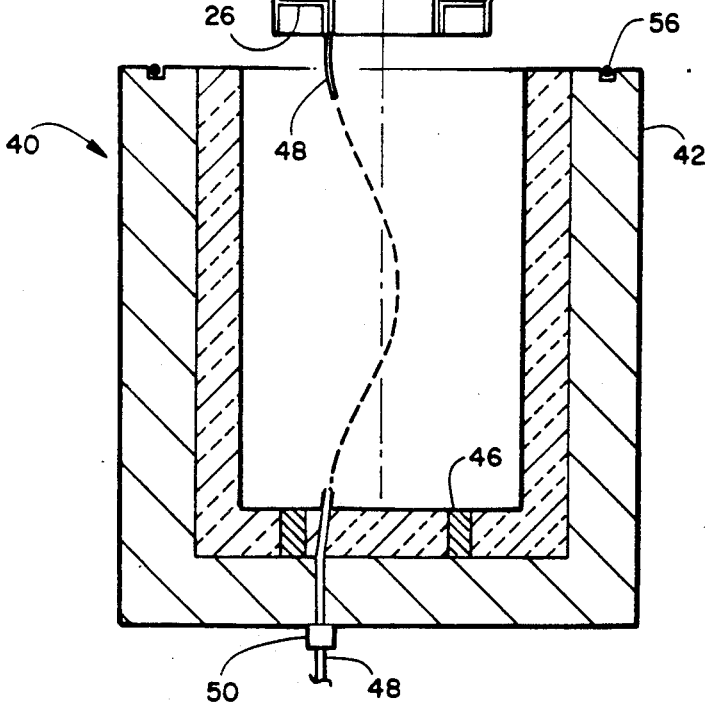

If desired, die 12 could have exterior grooves formed in the outer surface to aid in fracturing into fragments of selected size during removal or shallow slots could be cut in the outer surface of die 12 after removal of the covers to aid in fracturing the die. FIGS. 4*a*–4*c* illustrate the combination of a heater assembly 51 forming assembly 10 and a typical heating chamber 40. Forming assembly 10 is basically the same as that shown in FIGS. 2 and 3, except that a slightly different alternative embodiment of the vacuum purge line 30 is shown.

Heating chamber 40 consists of a shell 42, typically steel, with a thermal insulation lining 44 to reduce heat loss. Heating chamber 40 can be designed as a cold wall pressure vessel. If the lining does not have sufficient strength, a support ring 46 may be embedded in insulation 44 to support forming assembly 10. In this embodiment, a flexible vacuum purge line 48 is inserted through a hole in the bottom of chamber 40 and through insulation 44 to connect to forming assembly 10 at an interface between lower cover 26 and outer cover 24 or at any other convenient location.

As assembly 10 is lowered into chamber 40, tube 48 slides outwardly until assembly 10 rests on ring 46. A seal 50 surrounding tube 48 is placed to seal around tube 48 against the outer surface of shell wall 42 to prevent argon pressure from leaking out of the chamber during the forming operation.

Once assembly 10 is in place, the heater assembly cover 52 with downwardly extending heater 54 is lowered into place. The interface between cover 52 and the upper edges of shell 42 is sealed by O-ring 56. Air within chamber 40 is purged through tube 58 (either with an inert gas or vacuum) then forming pressure is applied by an inert gas introduced through tube 58. Meanwhile, at the desired time, heater 54 is activated through electrical wires 60.

When forming is complete, the gas pressure is released, the heater is turned off and cover 52 is removed. Forming assembly 10 is lifted out, vacuum line 48 is disconnected and the assembly is dissembled as discussed above.

While certain preferred materials and configuration were detailed in the above description of preferred embodiments those can be varied, where suitable, with similar results.

I claim:

1. A method of superplastic forming of hollow metal parts which comprises the steps of:

providing a hollow frangible ceramic die having an interior forming surface corresponding to the exterior surface of a part to be formed;

placing metal parts to be formed against the interior forming surface of said die;

enclosing the exterior of said die;

sealing the enclosure to said parts to provide a gas-tight enclosure for said die;

heating the resulting assembly to a selected forming temperature;

exposing said assembly to external forming pressure for a selected period;

reducing said pressure and cooling said assembly;

removing said enclosure; and breaking away said die to free the resulting formed part.

2. The method according to claim 1 wherein the exterior of said die is enclosed by placing sheet metal covers thereover and sealing interstices therebetween and between cover and parts by welding.

3. The method according to claim 1 wherein said frangible ceramic die is a surface of revolution.

4. The method according to claim 1 wherein said die ceramic is selected from the group consisting of alumina, fused silica and mixtures thereof.

5. The method according to claim 1 wherein said heat and pressure are applied in an autoclave.

6. The method according to claim 1 wherein more than one part is placed against said interior forming surface and said parts are diffusion bonded together.

7. The method according to claim 1 including the further step of weakening the exterior surface along selected lines to aid in breaking away said die after forming.

8. The method according to claim 1 including the further step of flushing said enclosure with an inert gas and evacuating said enclosure prior t said heating.

9. An apparatus for superplastic forming of metal parts which comprises:

a hollow frangible ceramic die having an interior forming surface corresponding to the desired exterior surface of a part to be formed;

an enclosure surrounding the exterior surface of said die and sealable to metal parts engaging said forming to form a gas-tight enclosure around said die;

means for heating the resulting assembly to a selected forming temperature; and means for applying substantially isostatic pressure to said assembly for a selected period.

10. The apparatus according to claim 9 wherein said enclosure comprises a plurality of sheet metal pieces with interstices therebetween and between pieces and said parts sealed with weldments producing a gas-tight enclosure.

11. The apparatus according to claim 9 further including a sealable opening through said enclosure adapted to introduce an inert gas into said enclosure and to evacuate gases from said enclosure.

12. The apparatus according to claim 9 wherein said ceramic die is formed from a material selected from the group consisting of alumina, fused silica and mixtures thereof.

13. The apparatus according to claim 9 wherein said die is a surface of revolution.

14. The apparatus according to claim 9 further including weakening grooves in the outer surface of said die to aid in breaking said die.

* * * * *